United States Patent [19]

Theurer et al.

[11] 4,249,467

[45] Feb. 10, 1981

[54] MOBILE APPARATUS FOR RECEIVING AND LAYING AS ASSEMBLED TRACK SWITCH OR CROSSING SECTION

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 87,063

[22] Filed: Oct. 22, 1979

[30] Foreign Application Priority Data

Nov. 16, 1978 [AT] Austria ..... 8195/78

[51] Int. Cl.[3] ..... E01B 27/06

[52] U.S. Cl. ..... 104/3

[58] Field of Search ..... 104/2, 3, 4, 5

[56] References Cited

U.S. PATENT DOCUMENTS

| | | | |
|---|---|---|---|
| 1,994,717 | 3/1935 | Kopke et al. | 104/3 |
| 2,696,791 | 12/1954 | Bovlard | 104/3 |
| 3,283,926 | 11/1966 | Eckardt et al. | 104/3 |

FOREIGN PATENT DOCUMENTS

| | | | |
|---|---|---|---|
| 2313055 | 9/1974 | Fed. Rep. of Germany | 104/3 |
| 2410718 | 11/1975 | Fed. Rep. of Germany | 104/3 |

*Primary Examiner*—Richard A. Bertsch

*Attorney, Agent, or Firm*—Kurt Kelman

[57] ABSTRACT

A mobile apparatus for laying assembled track switch and crossing sections comprises a bridge-like carrier frame supported at each end by a track-bound undercarriage and a track-laying undercarriage mounted independently of the track-bound undercarriages for pivoting about a vertical axis through an arc of at least 90° and for vertical adjustment. A hoist is mounted on the carrier frame between the undercarriages for gripping and transporting the assembled track sections.

7 Claims, 5 Drawing Figures

Figures 1, 2, 3:
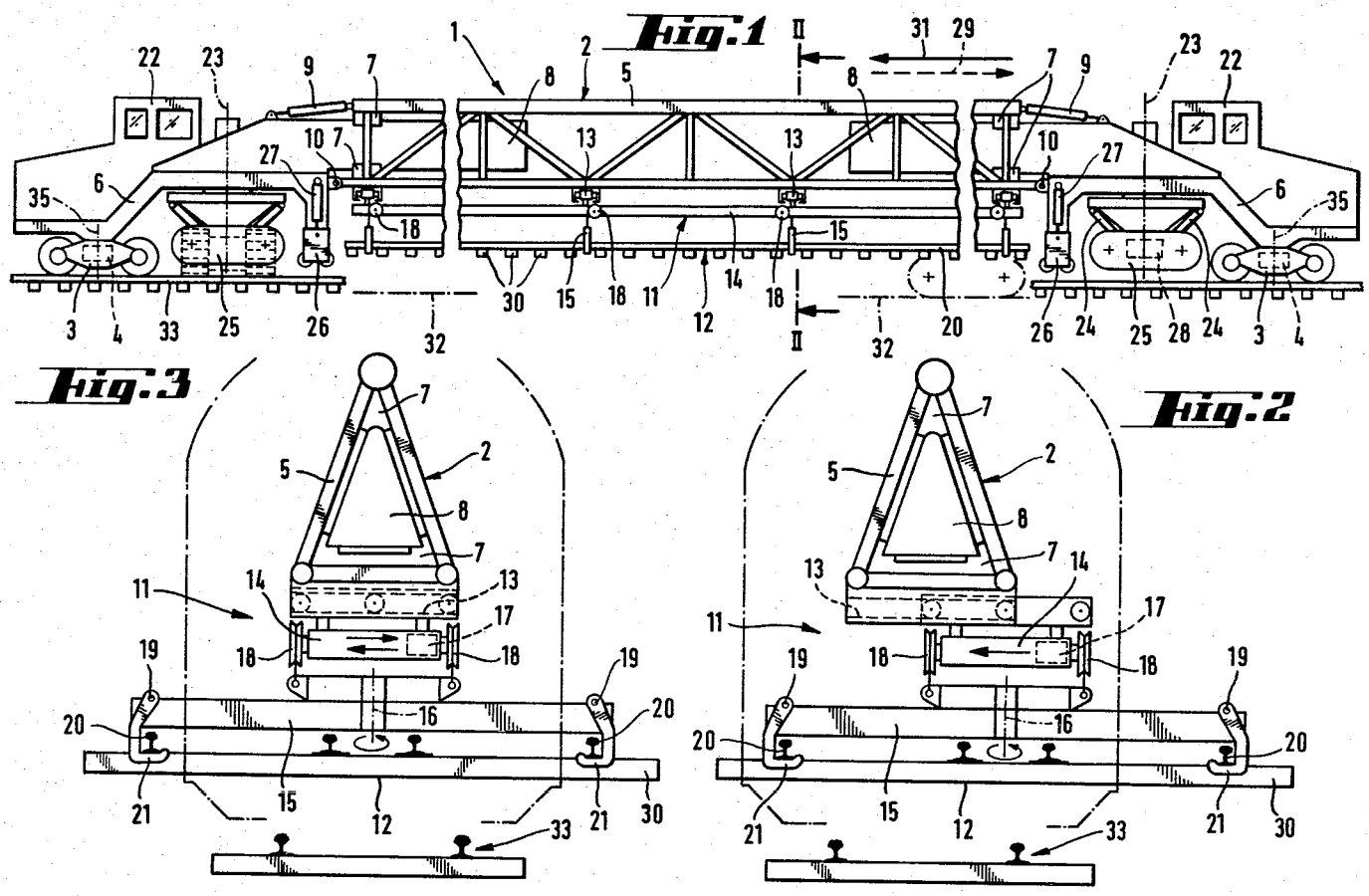

MOBILE APPARATUS FOR RECEIVING AND LAYING AS ASSEMBLED TRACK SWITCH OR CROSSING SECTION

The present invention relates to improvements in a mobile apparatus for receiving and laying an assembled track switch or crossing section consisting of rails fastened to ties, which comprises a hoisting and transport means including a device for gripping the assembled track switch or crossing section mounted between two track-bound undercarriages.

In our copending U.S. application Ser. No. 895,271, filed Apr. 10, 1978, we disclosed a mobile apparatus of this general type and comprising an elongated overhead girder extending above a transport vehicle or vehicles projecting beyond an end thereof. A guide track extends in a transport plane along the girder and a trolley is mounted on the guide track for movement therealong, the trolley including a vertically adjustable hoist for lifting and lowering a respect track section and for conveying it along the guide track in the transport plane. Gantry supports for the girder project laterally beyond the longitudinally extending sides of the vehicle(s) for leaving therebetween a transverse space for permitting passage of an assembled track switch or crossing section therethrough. The gantry supports include supports mounting the girder on the vehicle(s) and vertically adjustably supporting the projecting part of the girder on the ballast bed. The gantry supports are laterally adjustable transversely to the elongation of the girder and in a plane substantially parallel to the transport plane. This structure permits handling of relatively wide track sections without blocking a neighboring track.

Offenlegungsschrift (Published German Application) No. 2,410,718, published Sept. 11, 1975, discloses a mobile apparatus for receiving and laying assembled track sections, which comprises a bridge frame spanning the entire working site and being supported at respective ends by a singlewheel undercarriage, which may be pivoted out of the way, and an undercarriage which may run either on or off the track. While the apparatus may be moved in either direction, the assembled track sections can only be conveyed in one direction. This produces operating delays under many working conditions and makes it necessary to arrange traffic in conformity with the conveying direction. Furthermore, the nature of the undercarriages does not permit this apparatus to be used as a standard car connected to a work train moving along a track from one working site to another.

Offenlegungsschrift (Published German Application) No. 2,313,055, published Sept. 19, 1974, discloses a mobile apparatus for receiving and laying standard assembled track sections and incapable of handling track switch sections. The apparatus comprises a longitudinal carrier frame pivotally supported on two undercarriages each of which may be alternately used on or off the track. Since the track-bound wheels and the track-laying mechanism are mounted on the same undercarriage, they can only be driven together. Since railroad regulations impose severe restrictions on the length of the wheelbase, i.e. the distance between the undercarriages, only relatively short and standard track sections can be handled by this apparatus.

It is the primary object of this invention to improve an apparatus of the first indicated type so that it may be able more rapidly and in a simpler manner to handle assembled track switch or crossing sections for replacing such sections.

The above and other objects are accomplished according to the invention with a mobile apparatus which comprises a bridge-like carrier frame having two end regions, a respective track-bound undercarriage in each end region, the undercarriages supporting the carrier frame for mobility along a track, and a track-laying undercarriage in each end region, each track-laying undercarriage being mounted independently of the track-bound undercarriages for pivoting about a vertical axis through an arc of at least 90° and for vertical adjustment. A hoisting and transport means is mounted on the carrier frame between the end regions, the hoisting and transport means including a device for gripping the assembled track switch or crossing section.

The construction of the mobile apparatus in accordance with the present invention assures in an unexpectedly simple and advantageous manner not only a machine which may be used equally well for a variety of track maintenance operations in switches and crossings but a wide-ranging manoevrability independent of the course of the track, due to its movability transversely and obliquely to the track elongation, as well as a great adaptability in its motions to take into account operating requirements at the working site. The apparatus may be moved to and from the working site in either direction on the track but it may also be moved laterally on the track-laying undercarriages so that an old track section may be placed next to the track and a new track section may be received there for laying. This lateral movement requires no more than the laying of planks or transfer ramps to support the off-track undercarriages. If the mobile apparatus is moved to a track section storage place on a track leading thereto, an auxiliary track may be maintained between this track and the storage place for laterally moving the apparatus from the track to the storage place.

The mobile apparatus of this invention has special advantages on a working site where one side of the track is blocked, for example by masts, walls or sloped embankment. In this case, the apparatus may be moved to and from the working site on a track adjacent the track and opposite the blocked side thereof, and the off-track undercarriages are then pivoted so that the apparatus may be moved laterally from the neighboring track to the working site.

Furthermore, the apparatus may be temporarily moved laterally off the track, for example immediately after a new assembled track section has been laid, to permit a working crew to complete the assembly of the newly laid track section rapidly and without interference by the apparatus. All of this considerably shortens the operating cycle in the replacement of assembled track switch or crossing sections, thus correspondingly reducing dead times on the track.

Figure 5:
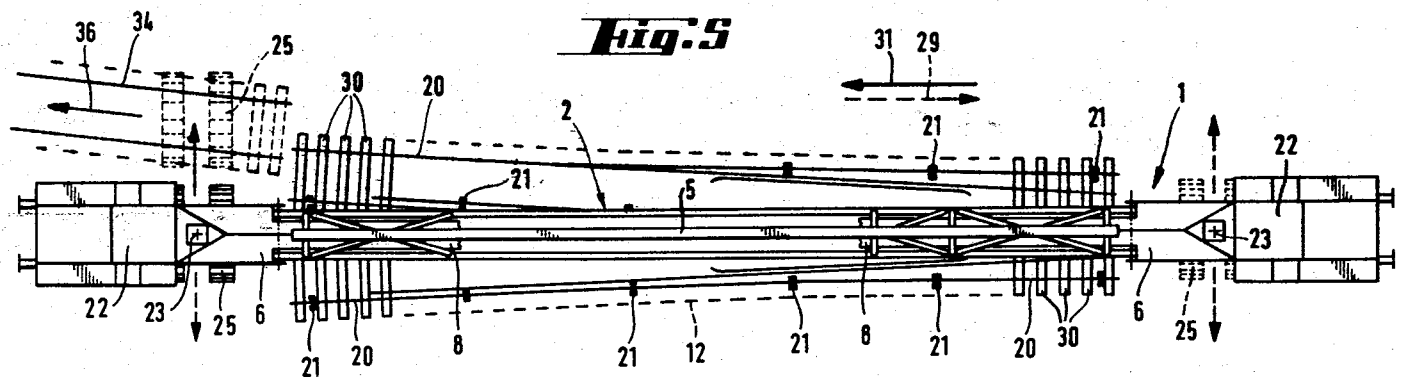
Figure 4:
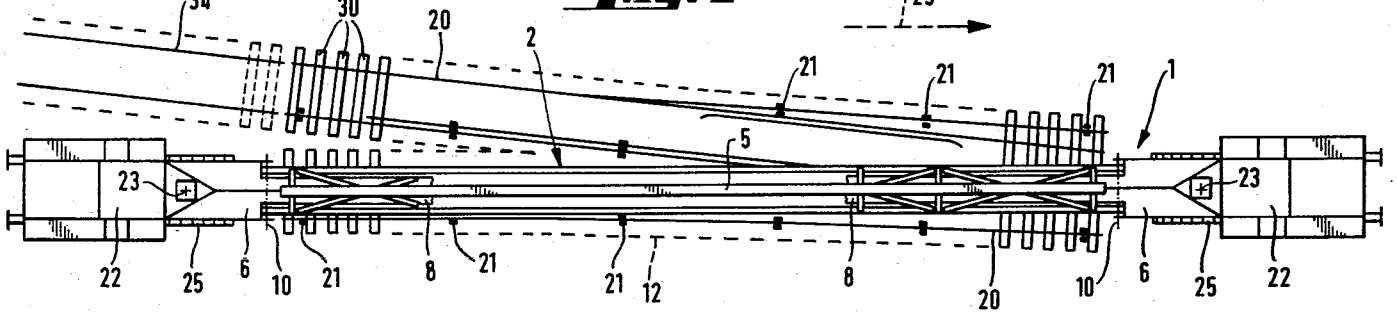

The above and other objects, advantages and features of the invention will become more apparent from the following detailed description of a now preferred embodiment thereof, taken in conjunction with the accompanying generally schematic drawing wherein FIG. 1 is a side elevational view of the mobile apparatus carrying a hoisted track switch, FIG. 2 is an enlarged sectional view along line II—II of FIG. 1, showing the hoisted track switch laterally displaced with respect to the track, FIG. 3 is a like sectional view, with the hoisted track switch substantially symmetrically positioned with respect to the track, FIG. 4 is a top view showing the mobile apparatus in working position ready to receive or lay an assembled track section, and FIG. 5 is a like top view showing the apparatus in a traveling position.

Referring now to the drawing and first to FIGS. 1 to 3, mobile apparatus 1 for receiving and laying assembled track switch or crossing section 12 consisting of rails 20 fastened to ties 30 is shown to comprise bridge-like carrier frame 2 having two end regions 6, 6. A respective track-bound undercarriage 3 in each end region 6 is illustrated as a swivel truck comprising its own independent drive 4. Track-laying or off-track undercarriage 25 is mounted in each end region 6 independently of track-bound undercarriage 3 for pivoting about vertical axis 23 through an arc of at least 90° and for vertical adjustment by hydraulic motors 24 whereby undercarriage 25 may be retracted. Hoisting and transport means 11 is mounted on carrier frame 2 between end regions 6, 6 and includes device 21 for gripping the assembled track switch or crossing section. Each of the track-laying undercarriages also has its own independent drive 28. In this manner, each undercarriage may be controlled and driven independently, which enhances the efficiency of the apparatus and makes it operation more adaptable.

In accordance with a preferred feature of the present invention, carrier frame 2 is comprised of at least two telescoping parts adjustable in relation to each other in a longitudinal direction, each track-laying undercarriage being mounted on a respective telescoping carrier frame part whereby the distance between the track-laying undercarriages may be varied. In the illustrated embodiment, the carrier frame is actually comprised of center part 5 on which hoisting and transport means 11 is mounted and two telescoping parts adjustable in relation to center carrier frame part 5 in the longitudinal direction, the adjustable parts constituting end regions 6 of carrier frame 2. For added rigidity, center carrier frame part 5 is constituted by a lattice girder and each adjustable carrier frame part 6 has a portion 8 projecting into the center part and glidably guided therealong in gliding bearings 7, 7. Drive means constituted by hydraulic motors 9, 9 interconnect the center and adjustable carrier frame parts for adjusting the adjustable parts in the longitudinal direction whereby the wheel base of the mobile apparatus may be changed. In this manner, the wheelbase may be adjusted to the standard requirements during traveling of the apparatus, either under its own power or as part of a work train. Thus, the apparatus may be moved between working sites at relatively high speeds, which is of considerable economic importance. On the other hand, the wheelbase may be lengthened at the working site to enable relatively long track switch or crossing sections to be received or laid, which is equally important from an economic point of view. At the same time, this adjustability of the wheel base also enables the position of the track-laying undercarriages to be brought into proper alignment with a transverse track or ramp provided for laterally offsetting the apparatus. During traveling or when working with relatively short track sections, adjustable carrier frame parts 6 may be fixed in their inner end positions by rigidly connecting them to center part 5 with fixing bolts 10, thus providing a rigid carrier frame.

According to another preferred feature, means 13 mounts hoisting and transport means 11 for transverse adjustment on carrier frame 2. In the illustrated embodiment, hoisting and transport means 11 comprises longitudinal carrier 14 which is transversely adjustably mounted on carrier frame center part 5 by rollers 13 running in transverse guides. In this manner, as shown in FIGS. 2 and 3, receiving or laying of a track section is greatly facilitated, regardless of the position of the apparatus on the main track or the branch track, since the track section may be positioned asymmetrically with respect to the track on which the apparatus stands. On the other hand, this lateral adjustability of the hoisting and transport means with respect to the carrier frame enables the assembled track section to be carried symmetrically with respect to the track when the apparatus travels between the track renewal site and the storage place for the track sections.

As shown in the drawing, several transverse carriers 15 are spaced from each other on longitudinal carrier 14 in the longitudinal direction and the transverse carriers are mounted on the longitudinal carrier for pivoting about vertical axis 16 and for independent vertical adjustment. In the illustrated embodiment, transverse carriers 15 are suspended from longitudinal carrier 14 on a hoist 18 including ropes trained over pulleys and drive 17 associated with the hoist enables the hoist to be turned about axis 16. The illustrated device for gripping assembled track switch section 12 comprises gripping hooks 21 mounted at respective ends of transverse carriers 15 for pivoting about horizontal axes 19 extending in the direction of track elongation to enable the hooks to subtend rails 20 of the track section and thus to grip the same for hoisting and transportation. This structural arrangement has the advantage that all gripping hooks may be readily and rapidly brought into the required positions for gripping the track section rails at predetermined points when the longitudinal carrier has been positioned for receiving the track section. The same advantage accrues during laying of the track section.

The illustrated bridge-like carrier frame comprised of a lattice framework center part and two telescoping end parts carrying the undercarriages provides a very stable construction capable of sustaining heavy loads while permitting rapid adjustment of the wheelbase.

In FIGS. 2 and 3, the approximate cross section of the mobile apparatus is indicated in chain-dotted lines to show how the hoisting and transport means 11 may be laterally offset in relation thereto. FIG. 2 shows this means moved to the right along roller track 13 with respect to carrier frame 2, hooks 21 gripping rails 20 of an assembled track switch section so that it extends far to the right on one side of track 33 while it is well within the boundaries of the apparatus on the left side. This asymmetrical position corresponds to the operating phase of apparatus 1 after an old track switch has been removed and lifted off the ballast bed and before a new track switch 12 has been laid, or during movement of the apparatus to or from a storage place for track switch sections if one side of the track on which the apparatus moves is blocked by masts or other obstacles which are avoided by laterally offsetting the hoisted track section in the illustrated manner.

FIG. 3 illustrates the normal symmetrical positioning of a hoisted track section 12.

As shown in FIG. 1, end carrier frame parts 6 are substantially identical and each end part is equipped with cab 22 and also carries track-bound auxiliary undercarriage 26 associated with each track-bound undercarriage 3. The auxiliary undercarriages are mounted for vertical adjustment by means of hydraulic motor 27 so that they may be retracted and each track-laying undercarriage 25 is arranged between one of track-bound undercarriages 3 and the associated auxiliary track-bound undercarriage 26. The auxiliary undercarriages are preferably laterally movable on carrier frame part 6 for transverse adjustment. This arrangement of the undercarriages facilitates the conversion from on-track to off-track operation, and vice versa. Also, the track-bound auxiliary undercarriages enable apparatus 1 to be moved on-track from the working site after an assembled track section has been laid.

The illustrated construction enables the wheelbase of undercarriages 3 to be reduced during traveling of the apparatus to enable the apparatus to move at high speeds under its own power, i.e. by operating drives 4, or coupled as a standard vehicle to a train, the use of swivel trucks for such undercarriages enabling the apparatus to take curves without difficulty. On the other hand, the wheelbase may be readily extended at a working site to accommodate relatively long track sections and to adapt the apparatus to all working conditions and requirements.

The operation of the apparatus will be understood from the above-described structure and will be explained in further detail with respect to specific operating phases, as also illustrated in FIGS. 4 and 5.

(1) Removal of a Track Switch Section

Apparatus 1 is moved on an access track in the direction of arrow 29 (FIG. 4) to the working site above track switch 12, with undercarriages 3, 3 in operating position and undercarriages 25 and 26 retracted. Hoisting and transport means 11 is then lowered into position to receive the track switch section to be removed, longitudinal carrier 14 being laterally positioned (see FIGS. 2 and 3) and/or pivoted so that, after transverse carriers 15 are lowered by tackles 18, gripping hooks 21 are in position to grip rails 20 between two adjacent ties 30. These hook engagements are shown strictly schematically in FIGS. 4 and 5. The tackles are then operated again to hoist the gripped track switch section and longitudinal carrier is positioned so that the hoisted track switch is symmetrical with respect to the track (see FIGS. 3 and 5).

If the hoisted track switch is to be transported in the direction of arrow 31 (see FIG. 5), apparatus 1 is first moved forwardly in that direction sufficiently to position rear off-track undercarriage 25 above the ballast bed region 32 (see FIG. 1) from which track switch 12 has just been removed. Hydraulic motors 24 are then operated to lower rear track-laying undercarriage 25 into engagement with the ballast bed (see chaindotted lines in FIG. 1) and rear carrier frame end part 6 is lifted sufficiently to raise rear track-bound undercarriage 3 above the track. Thereupon, drive 4 of front track-bound undercarriage 3 and drive 28 of ballast-engaging rear track-laying undercarriage 25 are operated to move apparatus 1 forwardly in the direction of arrow 31, partly on track 33 and partly on the ballast bed 32, until rear auxiliary track-bound undercarriage 26 is positioned above track 33. Hydraulic motor 27 is now operated to lower auxiliary undercarriage 26 into engagement with track 33, the rear track-laying undercarriage is retracted again and apparatus 1 is moved forward on track 33 engaged by front track-bound undercarriage 3 and rear track-bound auxiliary undercarriage 26 until rear undercarriage 3 is at track 33. The wheels of the rear undercarriage may now be engaged with track 33, possibly with the aid of a lateral adjustment of the rear auxiliary undercarriage, and apparatus 1 is now on track for movement on trackbound undercarriages 3, 3, rear undercarriage 26 being retracted again.

(2) Laying a New Track Switch Section

After the apparatus has traveled to a storage place for new track switch sections and has been loaded there with a new track switch section, apparatus 1 returns on track 33 to the working site and lays this new track switch section analogously to the manner in which the old section has been removed, i.e. the operating phases are simply reversed from the order described hereinabove. After the new switch section has been put in place, apparatus 1 may travel thereover to a new working site.

(3) Departure from the Working Site on a Branch Track

If conditions make it impossible or undesirable for apparatus 1 to depart from the working site on main track 33, it may also be switched to branch track 34 (see FIG. 5). For this purpose, front track-laying undercarriage 25 is pivoted in its retracted position about axis 23 by 90°. Planks or the like are then placed on the track to provide an even surface and hydraulic motors 24 are operated to lower undercarriage 25 into engagement with the evened surface of the track. The lowering of undercarriage 25 lifts carrier frame end part 6 sufficiently to raise track-bound undercarriage 3 off the track. Drive 28 is then operated to move front track-laying undercarriage 25 laterally in the direction of the transverse arrow shown in full lines at the left of FIG. 5 until undercarriage 25 is in vertical alignment with branch track 34. This lateral movement of the front end of apparatus 1 causes carrier frame 2 to pivot about vertical axis 35 of rear track-bound undercarriage 3. Front track-laying undercarriage 25 is now retracted again, causing front track-bound undercarriage 3 to engage branch track 34, enabling apparatus 1 to move forwardly in the direction of arrow 36 on the branch track, assuming that rear track-bound undercarriage 3 runs on a track section connected to branch track 34. Where, as in the illustrated example, a track section 12 of a double crossing switch is replaced, this is not the case. Therefore, to enable apparatus 1 to travel on branch track 34, rear track-bound undercarriage 3 must also be offset laterally and engaged with a track section connected to branch track 34. This is done in a manner analogous to that described hereinabove by pivoting rear track-laying undercarriage 25 into a transversely extending position and proceeding as described in connection with the front end.

(4) Combined Use of On- and Off-Track Undercarriages

Since track-laying undercarriages 25 are pivotal about a vertical axis for orienting them in the direction of the track or transversely thereto and since each undercarriage 25 can be driven independently, apparatus 1 may be moved parallel, perpendicularly or obliquely to the track, which makes the following operations possible:

If there is sufficient room laterally of the track at the working site, apparatus 1 may be moved to the side where there is room, for instance to put down an old track section which has just been removed. This may be done simply by operating the two track-laying undercarriages while the track-bound undercarriages are retracted and the track-laying undercarriages have been pivoted to extend transversely. In the same manner, a new track section placed next to the working site may be brought thereto by such a lateral movement of apparatus 1. All that is required for these operations are planks or other means for leveling the track surface for engagement by the track-laying undercarriages.

In another operation, apparatus 1 may be moved with the two track-laying undercarriages to a neighboring track after it has picked up a track section. Once in alignment with the neighboring track, the track-laying undercarriages are retracted and the track-bound undercarriages engage the track for movement thereover. The old track section may then be transported on the neighboring track to a suitable storage place. A new track section may be brought to the working site in an analogous manner.

The transverse movability of apparatus 1 by means of pivoted track-laying undercarriages 25 may also be used after a new track section has been laid to move the apparatus out of the way of operating personnel completing the assembly of the newly laid track section. Depending on the operating conditions and space available at the working site, this lateral displacement of apparatus 1 may be effected by operation of one or both track-laying undercarriages.

Where extensive track renewal work is involved, for instance where a network of track switches is laid in a railroad yard, apparatus 1 may be moved on and off track during the track laying operation as conditions may require.

What is claimed is:

1. A mobile apparatus for receiving and laying an assembled track switch or crossing section consisting of rails fastened to ties, which comprises (a) a bridge-like carrier frame having two end regions, (b) a respective track-bound undercarriage in each of said end regions, the undercarriages supporting the carrier frame for mobility along a track, (c) a track-laying undercarriage in each of said end regions, each track-laying undercarriage being mounted independently of the track-bound undercarriages for pivoting about a vertical axis through an arc of at least 90° and for vertical adjustment, and (d) a hoisting and transport means mounted on the carrier frame between the end regions, the hoisting and transport means including a device for gripping the assembled track switch or crossing section.

2. The mobile apparatus of claim 1, further comprising independent drive means for each of the undercarriages.

3. The mobile apparatus of claim 1 or 2, wherein the carrier frame is comprised of two telescoping parts adjustable in relation to each other in a longitudinal direction, each track-laying undercarriage being mounted on a respective one of the telescoping carrier frame parts whereby the distance between the track-laying undercarriages may be varied.

4. The mobile apparatus of claim 1 or 2, further comprising a respective track-bound auxiliary undercarriage associated with each of the track-bound undercarriages, the auxiliary undercarriages being mounted for vertical adjustment, and each track-laying undercarriage being arranged between one of the track-bound undercarriages and the associated auxiliary track-bound undercarriage.

5. The mobile apparatus of claim 1 or 2, further comprising means for mounting the hoisting and transport means for transverse adjustment on the carrier frame.

6. The mobile apparatus of claim 5, wherein the hoisting and transport means comprises a longitudinal carrier and at least two transverse carriers spaced from each other in the longitudinal direction, the transverse carriers being mounted on the longitudinally carrier for pivoting about a vertical axis and for independent vertical adjustment, the device for gripping the assembled track switch or crossing section comprises gripping hooks mounted at respective ends of transverse carriers, and the mounting means comprises transverse guide means for the longitudinal carrier.

7. The mobile apparatus of claim 1 or 2, wherein the carrier frame is comprised of a center part on which the hoisting and transport means is mounted and two telescoping parts adjustable in relation to the center part in a longitudinal direction, the adjustable parts constituting the end regions of the carrier frame and being glidably guided along the center part, and drive means interconnecting the center and adjustable carrier frame parts for adjusting the adjustable parts in the longitudinal direction.

* * * * *